US007757334B2

(12) United States Patent
Patel et al.

(10) Patent No.: US 7,757,334 B2
(45) Date of Patent: Jul. 20, 2010

(54) FLOOR CLEANING SYSTEM

(75) Inventors: Vinu Patel, Oakdale, MN (US); William J. Kopecky, Hudson, WI (US); Jeffrey M. Mailand, Hudson, WI (US); Scott J. Tuman, Woodbury, MN (US); Mark D. Sorlien, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1092 days.

(21) Appl. No.: 11/326,685

(22) Filed: Dec. 21, 2005

(65) Prior Publication Data

US 2007/0136973 A1 Jun. 21, 2007

(51) Int. Cl.
*A47L 13/10* (2006.01)

(52) U.S. Cl. ..... 15/231; 15/228; 15/247; 15/147.1

(58) Field of Classification Search ..... 15/228, 15/231, 229.1, 159.1, 247, 147.1
See application file for complete search history.

(56) References Cited

U.S. PATENT DOCUMENTS

| | | | | |
|---|---|---|---|---|
| 3,828,386 | A | 8/1974 | Roth | |
| 4,948,079 | A * | 8/1990 | Baeta | 248/309.1 |
| 5,344,693 | A | 9/1994 | Sanders | |
| 5,553,344 | A * | 9/1996 | Rosenkrantz | 15/104.002 |
| 6,298,517 | B1 | 10/2001 | McKay | |
| 6,405,403 | B1 | 6/2002 | McKay | |
| 6,810,554 | B2 | 11/2004 | McKay | |
| 2002/0065012 | A1 | 5/2002 | Takabayashi et al. | |
| 2003/0009839 | A1 | 1/2003 | Streutker et al. | |
| 2003/0028988 | A1 * | 2/2003 | Streutker et al. | 15/228 |
| 2005/0000047 | A1 | 1/2005 | Kelly et al. | |

FOREIGN PATENT DOCUMENTS

| | | | |
|---|---|---|---|
| GB | 2 233 882 | A | 1/1991 |
| JP | 12-245671 | A | 9/2000 |
| JP | 3628606 | B2 | 3/2005 |
| WO | WO 03/000107 | A1 | 1/2003 |
| WO | WO 03/000108 | A1 | 1/2003 |
| WO | WO 2004/060133 | A1 | 7/2004 |

* cited by examiner

*Primary Examiner*—Shay L Karls
(74) *Attorney, Agent, or Firm*—Trisha D. Adamson

(57) ABSTRACT

A cleaning tool for cleaning a surface is disclosed. The cleaning tool comprises a cleaning frame including a rigid body defining a perimeter surrounding an interior opening and at least one spacer arranged within the interior opening. The cleaning frame secures over a backing.

10 Claims, 2 Drawing Sheets

FLOOR CLEANING SYSTEM

FIELD

The present invention relates to a floor cleaning system. In particular, the present invention relates to a cleaning tool including a cleaning frame that secures to a mop.

BACKGROUND

Cloths and other wipes are used over mop head for cleaning surface such as floors. Most wipes, are made from either a woven or nonwoven sheet, and are attached to a tool like a mop handle to move dirt and dust in a desired direction. Typically, most wipes products do not have the ability to effectively capture and retain small and large particles of dirt and debris. During cleaning, when the dirt or dust has been collected, the wipe may be removed from the mop and scrunched up by the user to try to capture the dirt or sand that has been collected so that it can be shaken out in the trash. This process is repeated during cleaning and often requires a user who is attempting to pick up larger particles such as sand to repeat the process several times to pick up all the sand or heavier particles that have been collected. In other cases, the user will use several wipes to entirely pick up the dirt and debris. Many times a user will pickup the debris with a broom and dust pan once it has been gathered into a pile with the wipe.

Adhesive may be incorporated into a wipe to assist with retaining both small and large particle of dirt and debris within the wipe. However, there may not be sufficient quantities of adhesive to capture large particles. Use of an entirely coated adhesive sheet is impractical because due to the tack of the adhesive, the adhesive sheet cannot be easily slid over the surface to be cleaned. Therefore, sufficient spacing between the surface being cleaned and the adhesive layer is necessary to provide sufficient glide of the wipe while still providing sufficient pick-up of the dirt and debris.

SUMMARY

The present invention relates to a cleaning tool. In one embodiment the cleaning tool comprises a cleaning frame including a rigid body defining a perimeter surrounding an interior opening and at least one spacer arranged within the interior opening. The cleaning frame secures over a backing.

In another embodiment, a cleaning attachment for a mop head having a cleaning surface is disclosed. The cleaning attachment comprises a frame defining an interior opening, at least one spacer arranged in the interior opening, and a fastener for attaching the frame to the mop head. The spacer is a compliant material with structural integrity to provide distance between the surface to be cleaned and the mop head cleaning surface. When the attachment is attached to the mop head, the spacer is arranged adjacent the mop head cleaning surface; and In another embodiment, the cleaning tool for cleaning a surface comprises a cleaning frame including (a) a body defining a perimeter at least partially surrounding an interior opening and (b) at least one spacer within the interior. The spacer is linear with a first end connected to the perimeter and a second end connected to the perimeter. The cleaning tool further comprises a backing and a cleaning sheet having a substantially planar working surface. The cleaning frame secures over the backing and the sheet such that a portion of the sheet is between the backing and the cleaning frame.

In another embodiment, the cleaning tool comprises a cleaning frame including (a) a body defining a perimeter surrounding an interior opening and (b) a plurality of parallel spacers within the interior opening. Each spacer is linear with a first end connected to the perimeter and a second end connected to the perimeter. The cleaning tool further comprises a mop head and a stack of cleaning sheets having a substantially planar working surface covering at least a portion of the mop head. The working surface is at least partially covered with adhesive. The cleaning frame removably secures over the mop head and the stack of cleaning sheets such that a portion of the adhesive of the working surface is covered by the spacers and a portion of the adhesive of the working surface is exposed by the interior opening.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
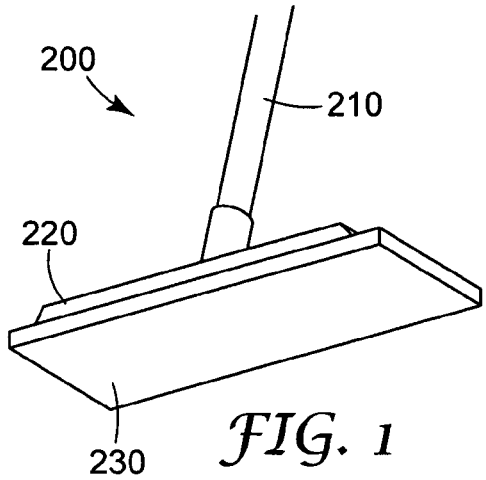
FIG. 1 is a bottom perspective view of a mop.

FIG. 1 is a bottom perspective view of a mop 200. The mop 200 includes a handle 210 that pivotally connects to a backing 220. The mop 200 includes a working surface 230. Typically, mops 200 such as the one shown in FIG. 1 are used to clean a flat surface such as a floor. A wipe, either cloth or a nonwoven, is attached over the working surface 230 and wrapped up and around the backing 220 to secure to the mop 200. The wipe may be wet or dry and assists with collection and picking up the dirt, dust, hair and other debris on the surface to be cleaned. Mops 200 such as the one shown in FIG. 1 often have a rigid backing 220 and at the working surface have a relatively compliant surface (not shown). The compliant surface may be of such materials as foam and in particular closed-cell foam.

Figure 2:
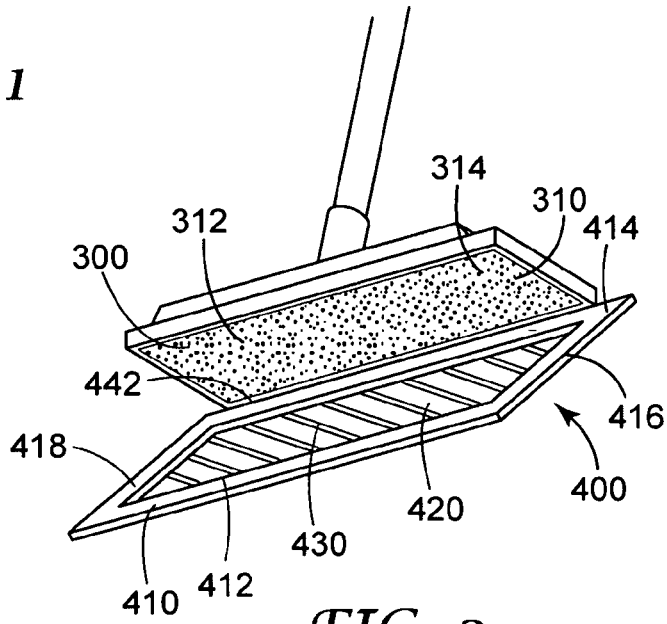
FIG. 2 is a bottom perspective view of the mop of FIG. 1 with a cleaning frame hingedly connected to the mop.
Figure 3:
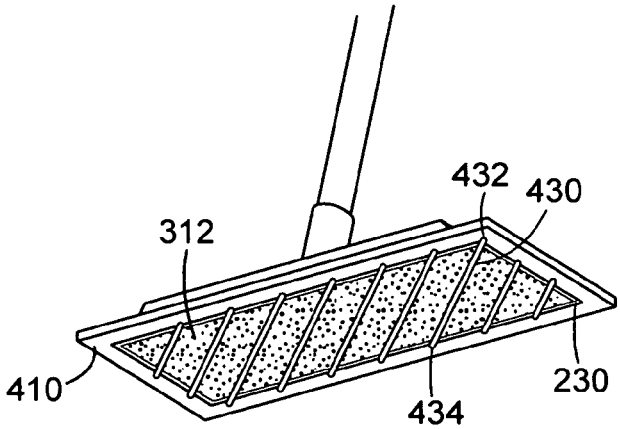
FIG. 3 is a perspective view of the mop of FIG. 2 with the cleaning frame closed over the mop.
Figure 4:
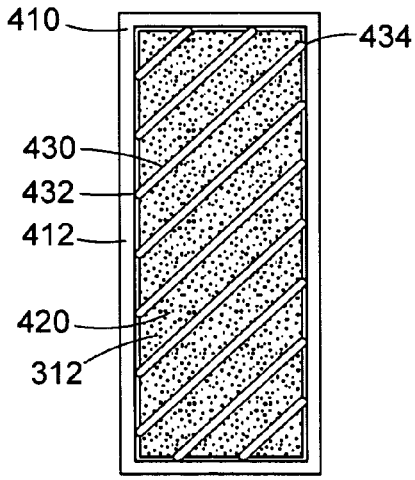
FIG. 4 is a bottom view of the mop and cleaning frame shown in FIG. 3.

FIG. 2 is a bottom perspective view of the mop 200 of FIG. 1 with a cleaning attachment 400 hingedly connected to the mop 200 in an open position. FIG. 3 is a perspective view of the mop 200 of FIG. 2 with the cleaning attachment 400 closed over the mop 200. FIG. 4 is a bottom view of the mop 200 and cleaning attachment 400 shown in FIG. 3.

In the embodiment shown in FIGS. 2-4, the cleaning attachment 400 includes a cleaning frame 410 having a first side 412, a second side 414, a third side 416, and a fourth side 418 that define a perimeter surrounding a central opening 420. The hinge 442 may be a separate mechanical attachment or may be a living hinge between the mop 200 and the cleaning frame 410. The cleaning frame 410 attaches to a portion of the mop 200 so that the cleaning frame 410 can hinge between an open position as shown in FIG. 2 and a closed position as shown in FIG. 3. The cleaning frame 410 shown includes a perimeter surrounding the entire opening 420. It is understood that the cleaning frame 410 is a support structure, that only requires at least one side adjacent the opening 420, and therefore not surrounding the entire opening 420.

A cleaning sheet 300 is attached to the working surface 230 of the backing 220. The cleaning sheet 300 may be a woven, nonwoven, wet or dry wipe. Preferably, the cleaning sheet 300 includes adhesive 312 at its working surface 314. The adhesive 312 may be continuous, discontinuous or interrupted. The cleaning sheet 300 may or may not be fixedly attached to the working surface 230 of the mop 200. To fixedly attach the cleaning sheet 300 to the mop 200, the working surface 230 of the mop may include an adhesive that allows for securing the cleaning sheet 300 but also allows for removal or repositioning of the cleaning sheet 300. A single sheet or a stack of sheets may be used.

Figure 7:
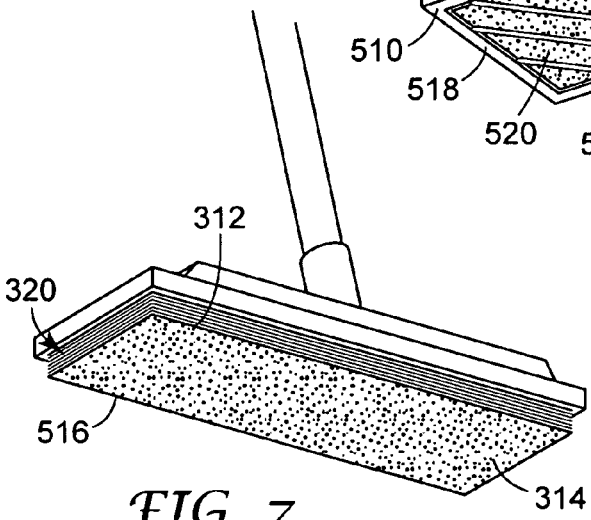
FIG. 7 is a perspective view of the mop of FIG. 1 with a plurality of cleaning sheets.

FIG. 7 shows a stack 320 of cleaning sheets 300. A plurality of sheets 300 are stacked one on top of the other such that the adhesive 312 on one sheet contacts the top (reference FIG. 7) surface of a subsequent sheet 300 to form a stack 320. The stack 320 is attached to the working surface 230 of the mop 200 such that the adhesive 312 and working surface 314 of the cleaning sheet now form the working surface of the mop 200.

Typically, the top (reference FIG. 7) of the cleaning sheet 300 does not include an adhesive. In some embodiments the top surface of the cleaning sheet 300 may include a release treatment such as flame treatment, corona treatment, roughening, release liner, or release coatings such as silicones, fluorochemicals, acrylates, polyurethanes, and polyvinylacetates that can be cured via thermal, ultraviolet, or electron beam mechanisms to facilitate removal from the adhesive on the cleaning sheet above it or to facilitate removal from the working surface 230 of the mop 200.

Examples of suitable material for the cleaning sheet backing include a woven, a nonwoven, paper, polymeric and plastic film materials including polyolefins such as polyethylene, polypropylene, copolymers of ethylene or propylene, halogenated polymers such as poly(vinyl chloride) and poly(vinylidene chloride) polyesters such as polyethylene terephthalate, polyurethanes, and poly(vinyl acetate) and vinyl acetate copolymers. Polypropylenes can include monoaxially oriented polypropylene, biaxially oriented polypropylene, simultaneously biaxially oriented polypropylene, and untensilized polypropylene including untensilized isotactic polypropylene. Various types of nonwoven synthetic polymeric backings including spun-bond polyethylene could be used. The sheet material can be compostible or degradable, can be colored, can be printed, can be fragranced, and can be of different surface textures or embossed. Each sheet may include a textured adhesive surface having raised portions and recessed portions. A textured adhesive surface is described in U.S. Pat. No. 6,865,765 the disclosure of which is herein incorporated by reference.

Suitable adhesives for the layer of adhesive 312 include hot melt-coated formulations, transfer-coated formulations, solvent-coated formulations, and latex formulations. Preferably, the layer of adhesive is a pressure-sensitive adhesive. General categories of pressure-sensitive adhesives can be based on natural rubber, styrene butadiene, butyl rubber and polyisobutylene, styrenic block copolymers, ethylene-vinyl acetate and related copolymers, poly-alpha olefins, acrylic adhesives, silicone, butadiene-acrylonitrile, polychloroprene, polybutadiene, atactic polypropylene, or repulpable pressure-sensitive adhesive. (From the *Handbook of Pressure Sensitive Adhesive Technology*, Third Edition, Edited by Donatas Satas, Satas & Associates, 1999.) However, other pressure-sensitive adhesives may be used for adhesive layer 320, such as those with the properties described in *Adhesion and Adhesives Technology an Introduction*, p. 216, Alphonsus V. Pocius, Hanser Gardner Publications, Inc., 1997. The Pressure-Sensitive Tape Council has defined pressure-sensitive adhesives as materials with the following properties: 1) aggressive and permanent tack; 2) adheres with no more than finger pressure; 3) requires no activation by any energy source; 4) has sufficient ability to hold onto the adherend; and 5) has enough cohesive strength to be able to be removed cleanly from the adherend.

Examples of adhesives useful for the layer of adhesive 312 include those based on general compositions of polyacrylates; polyvinyl ethers; diene-containing rubbers such as natural rubber, polyisoprene, and polyisobutylene; polychloroprene; butyl rubber; butadiene-acrylonitrile polymer; thermoplastic elastomers; block copolymers such as styrene-isoprene and styrene-isoprene-styrene block copolymers, styrene-diene type block copolymers such as SBS, SIBS, SEBS, and SEPS, or styrene-ethylene-butylene, hydrogenated SBS, hydrogenated SIS, styrene-ethylene-propylene-styrene, ethylene-propylene-diene polymers, and styrene-butadiene polymer; poly-alpha-olefin; amorphous polyolefins; silicones; ethylene-containing copolymers such as those prepared from ethylene vinyl acetate, ethylacrylate, and ethyl methacrylate; polyurethanes; polyamides; epoxies; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, fragrance, and solvents.

Within a portion of the central opening 420 is at least one spacer 430. The spacer 430 is a compliant material that maintains spacing between the surface to be cleaned and the working surface of the mop 200. The spacer 430 functions to capture and collect dirt and debris and prevents total contact of the adhesive 312 with the surface to be cleaned.

If the adhesive 312 completely contacts the surface to be cleaned, then the mop 200 will not effectively glide on the surface to be cleaned. Without the spacer 430, the cleaning sheet 300 is slid on the surface to be cleaned and essentially just the leading edge is available for picking up dirt and debris. When dirt and debris only collects at the leading edge, then only a limited the amount of dirt and debris can be picked up.

Lifting the cleaning sheet 300 from the surface to be cleaned exposes more surface area of the cleaning sheet 300 for picking up dirt and debris. The dirt and debris are raised from the surface to be cleaned and so the top of the dirt and debris can be retained by the cleaning sheet 300. Therefore, when the working surface 230 of the mop or in particular the working surface 314 of the cleaning sheet 300 is removed from the surface to be cleaned by the spacer 430 more dirt and debris is capable of being captured, collected, and retained on the cleaning sheet.

The spacer 430 provides an open structure that the cleaning sheet 300 can glide on and may be provided in any number of arrangements and materials. One particular embodiment of the spacer 430 will be discussed with respect to FIGS. 2, 3, and 4. Each spacer 430 shown in the embodiment of FIGS. 2, 3, and 4 includes a first end 432 and a second end 434. The first end 432 is attached to a portion of the cleaning frame 410 and the second end 434 is attached to a portion of the cleaning frame 410. The resulting arrangement of the spacer in this embodiment is linear and arranged generally diagonal with respect to the first side 412 of the cleaning frame 410. Although the spacers are shown to be linear and diagonally arranged a variety of other arrangement may be included such a grid or scrim, waves, zig-zag, spiral, etc.

In the embodiment shown in FIGS. 2, 3, and 4, a plurality of spacers 430 are included and the spacers 430 are parallel. It is not necessary to have a plurality of spacers. It is only necessary that there is at least one spacer 430 structure in the central opening 420. Also, it is understood that the spacer 430 would not cover the entire central opening 420. Further, if a plurality of spacers 430 is included, the spacers 430 need not be parallel. The spacers 430 may be nonparallel, randomly arranged or arranged in another nonparallel pattern.

The spacer 430 is preferably a compliant material so that itself may capture and retain dirt and debris. Preferably, the spacer is at least 5 mils thick. Because the spacer is in direct contact with the surface to be cleaned, preferably, the spacer is of a material that will not damage the surface to be cleaned. Therefore, preferably, the spacer is a compliant material without sharp edges and rough surfaces. However, if the surface to be cleaned is a fabric-like surface like carpet, then the spacer should be smooth to allow for a smooth glide on the surface to be cleaned.

Suitable material for the spacer 430 may be a natural or synthetic material. Examples of material that may be used are nonwovens, wovens, knitted material, foams, sponges, yarns, rows of bristles, extruded polymers, or a fabric surrounded metals, i.e. pipe cleaner. For an extruded strand, suitable materials include polypropylene, polyethylene or olefin copolymers and other thermoplastics. The cross section of the spacer strand may be shaped such as round, oval, star shaped, rectangle, or hollow (i.e., capillary). The plastic may be foamed to make it lighter or more flexible.

Figure 6:
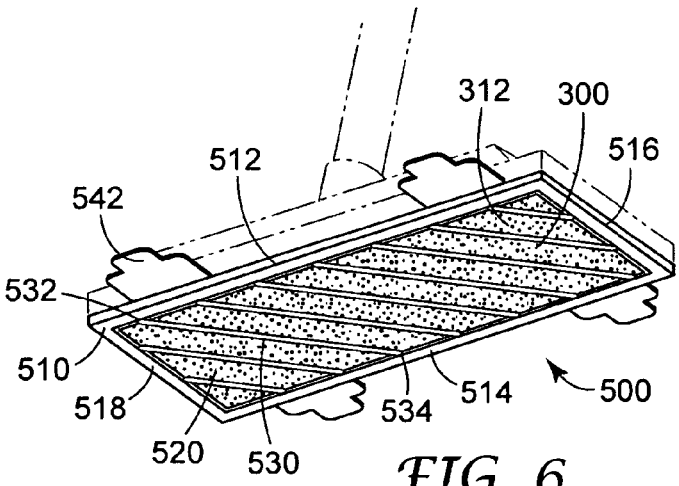
FIG. 6 is a bottom perspective view of the mop of FIG. 1 with an alternative cleaning frame.

The spacer 430 may be permanently secured to the frame 410 or may be removable from the frame 410. If permanently secured to the frame 410, when the spacer 430 has worn then the entire mop 200 is discarded or if the cleaning attachment 500 shown and described with respect to FIG. 6 is included, just the cleaning attachment is replaced over a consistent mop. Alternatively, the spacer 430 may be removable and replaceable and when worn only the spacer is replaced.

Overall, the cleaning attachment 400 hingedly connects to the backing 220 of the mop. This allows the cleaning attachment 400 to be partially removable from the backing 220 of the mop 200 so that a cleaning sheet 300 can be placed between the working surface 230 of the mop 200 and the cleaning attachment 400. The cleaning frame 400 attaches to a portion of the mop 200 so that the cleaning frame 400 can hinge between an open position as shown in FIG. 2 and a closed position as shown in FIG. 3. In an arrangement such at this shown in the embodiments of FIG. 2-4, the frame 410 of the cleaning attachment 400 secures to the working surface 230 of the mop 200. The hinge may be a separate mechanical attachment or may be a living hinge between the mop 200 and the cleaning frame 410.

When the cleaning attachment 400 is in a closed position, FIGS. 3 and 4, a portion of the cleaning sheet 300 is covered by the spacers 430, but a portion of the cleaning sheet is exposed through the central opening 420. The exposed portion of the cleaning sheet provides the surface that will pick up dirt and debris from the surface to be cleaned and therefore become the working surface 314. The thickness of the frame 410 can be set to accommodate a stack 320 of sheets 300 if included.

To use the mop 200 having the cleaning attachment 400, a cleaning sheet 300 is provided between the working surface 230 of the mop 200 and the cleaning attachment 400. The mop 200 is maneuvered over the surface to be cleaned which may include such surfaces as floors, walls having materials such as wood, tile, laminates, and carpet. Dirt and debris are collected and trapped by the spacers 430 and secured to the cleaning sheet 300, and in particular secured to the adhesive 312 if included. When finished, the cleaning attachment 400 is opened and the cleaning sheet 300 may be removed. If a stack 320 of cleaning sheets 300 is included, the next cleaning sheet 300 will be in place and ready for use when the cleaning attachment 400 is closed.

Figure 5:
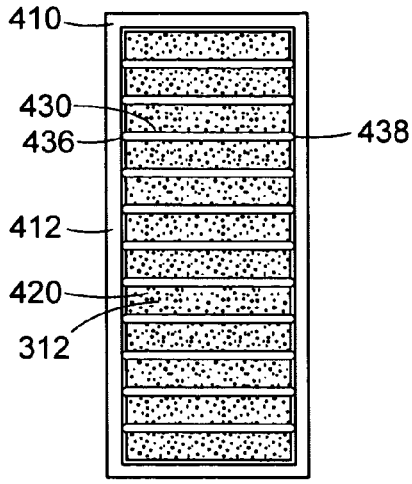
FIG. 5 is a bottom view of an alternative embodiment of a cleaning frame.

FIG. 5 is a bottom view of an alternative embodiment of a cleaning attachment having an alternative arrangement of the spacers 430. Each spacer 430 shown in the embodiment of FIG. 5 includes a first end 436 and a second end 438. The first end 436 is attached to a portion of the cleaning frame 410 and the second end 438 is attached to a portion of the cleaning frame 410. The resulting arrangement of the spacer 430 in this embodiment is linear and arranged generally perpendicular with respect to the first side 412 of the cleaning frame 410.

FIG. 6 is a bottom perspective view of the mop of FIG. 1 with an alternative cleaning attachment 500. The cleaning attachment 500 includes a cleaning frame 510 having a first side 512, a second side 514, a third side 516, and a fourth side 518 that define a perimeter surrounding a central opening 520. Extending in the central opening is at least one spacer 530, which includes a first end 532 attached to the cleaning frame 510 and a second end 534 attached to the cleaning frame 510 to form a generally linear spacer 530. In this embodiment, a plurality of spacers 530 are included and are parallel.

As was discussed above with respect to FIG. 2-6, a cleaning sheet 300 is positioned between the working surface 230 of the mop 200 and the cleaning attachment 500. In this embodiment, the cleaning sheet 300 includes an adhesive 312 that is partially covered by the spacer 530 and partially exposed through the central opening 520.

In contrast to the cleaning attachment 400 shown in FIG. 2 that hingedly connects to the mop 200, the cleaning attachment 500 shown in FIG. 6 is entirely removable from the mop 200. This allows the cleaning attachment 400 to be entirely removed from the backing 220 of the mop 200 so that a cleaning sheet 300 can be placed between the working surface 230 of the mop 200 and the cleaning attachment 500. In this arrangement, the cleaning attachment 500 could be used with any existing mop 200 and would not need to be designed to be an integral part of the mop 200.

FIG. 6 show that mechanical fasteners 542 could be included as part of the cleaning attachment 500 to secure the cleaning attachment to the mop 200. Such mechanical fasteners 542 could be spring-loaded hinges to wrap up and around the mop 200, snap-fit, or a sliding channel having grooves. Alternatively, hook and loop, adhesive, magnets, or other such fasteners may be used to connect the cleaning frame 510 to the mop.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A cleaning tool for cleaning a surface, the cleaning tool comprising:

a cleaning frame including (a) a body defining a perimeter at least partially surrounding an interior opening and (b) at least one spacer within the interior, wherein the spacer is linear with a first end connected to the perimeter and a second end connected to the perimeter and wherein the spacer comprises a plurality of fibers forming a relatively soft and compliant material capable of retaining fine dust and particles;

a backing;

a cleaning sheet having a substantially planar working surface, wherein the cleaning sheet comprises an adhesive surface such that a portion of the adhesive surface is covered by the spacer and a portion of the adhesive surface is exposed to the surface to be cleaned by the interior opening;

wherein the spacer comprises a plurality of fibers with structural integrity to provide distance between the surface to be cleaned and the cleaning sheet wherein the cleaning frame secures over the backing and the sheet such that a portion of the sheet is between the backing and the cleaning frame.

2. The cleaning tool of claim 1, wherein the backing is a substantially planar mop head.

3. The cleaning tool of claim 1, wherein the spacers are a fabric, nonwoven, yarn, or fabric surrounded metal wire.

4. The cleaning tool of claim 1, wherein the cleaning frame is modular and separately removable from the backing.

5. The cleaning tool of claim 1, further comprising a plurality of spacers.

6. The cleaning tool of claim 5, wherein the spacers are parallel.

7. The cleaning tool of claim 1, wherein the cleaning frame is hingedly connected to the backing and partially removable from the backing.

8. A cleaning tool for cleaning a surface, the cleaning tool comprising:

a cleaning frame including (a) a body defining a perimeter surrounding an interior opening and (b) a plurality of parallel spacers within the interior opening, wherein each spacer is linear with a first end connected to the perimeter and a second end connected to the perimeter, and wherein the spacers comprise a plurality of fibers forming a relatively soft and compliant material capable of retaining fine dust and particles;

a mop head;

a stack of cleaning sheets having a substantially planar working surface covering at least a portion of the mop head, wherein the working surface is at least partially covered with adhesive;

wherein the cleaning frame removably secures over the mop head and the stack of cleaning sheets such the a portion of the adhesive of the working surface is covered by the spacers and a portion of the adhesive of the working surface is exposed by the interior opening;

wherein the perimeter of the body forms a planar surface that entirely surrounds the stack of cleaning sheets and wherein the spacers project beyond the planar surface of the body.

9. The cleaning tool from of claim 8, wherein each spacer is a compliant material with structural integrity to provide distance between the working surface of the cleaning sheet and the surface to be cleaned.

10. The cleaning tool of claim 8, wherein the cleaning frame is hingedly connected to the mop head and partially removable from the mop head.

* * * * *